United States Patent [19]

Kamiyama

[11] Patent Number: 4,788,669

[45] Date of Patent: Nov. 29, 1988

[54] ELECTRONIC TIMEPIECE

[75] Inventor: Yasuo Kamiyama, Tanashi, Japan

[73] Assignee: Citizen Watch Co., Ltd., Tokyo, Japan

[21] Appl. No.: 65,079

[22] Filed: Jun. 22, 1987

Related U.S. Application Data

[63] Continuation of Ser. No. 689,262, Jan. 2, 1985, abandoned.

[30] Foreign Application Priority Data

Jan. 13, 1984 [JP] Japan ..... 59-4404

[51] Int. Cl.[4] ..... G04B 19/00; G04F 5/00

[52] U.S. Cl. ..... 368/80; 368/160; 368/88

[58] Field of Search ..... 368/76, 80, 88, 110–113, 368/157, 160, 223, 228

[56] References Cited

U.S. PATENT DOCUMENTS

| | | | |
|---|---|---|---|
| 3,884,035 | 5/1975 | Jeannet et al. | 368/110 |
| 4,211,066 | 7/1980 | Kusumoto et al. | 368/113 |
| 4,243,329 | 1/1981 | Nakayama | 368/76 |
| 4,266,288 | 5/1981 | Berney | 368/68 |
| 4,275,463 | 6/1981 | Ishida | 368/187 |
| 4,364,669 | 12/1982 | Thoenig et al. | 368/111 |
| 4,398,832 | 8/1983 | Maire et al. | 368/80 |
| 4,440,502 | 4/1984 | Kanno | 368/80 |
| 4,523,857 | 6/1985 | Ushikoshi | 368/157 |

*Primary Examiner*—Vit W. Miska

*Attorney, Agent, or Firm*—Birch, Stewart, Kolasch, & Birch

[57] ABSTRACT

An electronic watch has a mechanical analog time-display with hour, minute and second hands. The watch has gear trains disposed in a portion adjacent the axis of the minute hand, and two motors disposed adjacent the gear train for driving the minute hand, hour hand and second hand. A stem is axially shiftably provided adjacent the gear train, and a lever assembly such as a setting lever, clutch lever and sliding clutch wheel is disposed adjacent the stem. A battery is disposed between the lever assembly and one of the motors, and a circuit chip is disposed between the motors.

12 Claims, 16 Drawing Sheets

ELECTRONIC TIMEPIECE

This application is a continuation of application Ser. No. 689,262 filed on Jan. 7, 1985, now abandoned.

BACKGROUND OF THE INVENTION

The present invention relates to an electronic timepiece, and more particularly to an electronic watch having a mechanical analog time-display with hands which are driven by at least two motors.

A conventional electronic watch having the analog time-display with hands is not provided with an alarm system. However, as digitial display timepieces are improved, demand for an analog time-display watch having a plurality of functions such as alarm, timer, and others is increasing. On the other hand, the alarm watch must be so arranged that a set alarm time is indicated by manipulating a knob of the watch, in order to inform the set alarm time to a user, which is useful to turn on the alarm system to alarm ON-state or to set a different alarm time. In addition, it is necessary to quickly indicate the alarm time. In the analog time-display watch, hands are driven by a motor. Accordingly, in order to quickly drive the hands including the second hand to set time positions, the motor must be rotated at a high speed. However, it is difficult to drive the hour hand, minute hand and second hand, which are interconnected by gear trains, by only one motor at a high speed. Therefore, it is desirable to provide two or three motors for quickly rotating the hands, respectively. However, the increase of the number of motors renders the watch large in size and in thickness because of the superimposing gears. Further, if motors are disposed adjacent to each other, troubles caused by interferences in magnetic fields occur to decrease the accuracy of operation of the motors.

SUMMARY OF THE INVENTION

An object of the present invention is to provide an electronic timepiece having at least two motors, which may be made into small size and thin thickness.

Another object of the present invention is to provide an electronic timepiece in which motors are disposed so as not to deteriorate the characteristics of each motor.

According to the present invention, there is provided an electronic timepiece having a mechanical analog time-display with hour, minute and second hands, comprising gear trains disposed in a portion adjacent the axis of the minute hand, and two motors disposed adjacent the gear train for driving the minute hand, hour hand and second hand through the gear train. The timepiece has a stem axially shiftably provided adjacent the gear train, a lever assembly disposed adjacent the gear trains and operatively connected to the stem for changing the operational state of the timepiece, a battery disposed between the lever assembly and one of the motors, and a circuit chip disposed between the motors, the circuit chip being substantially at the same level as the motors.

In an aspect of the present invention, one of motors is arranged to give only the second hand, and both motors are so disposed such that the axial lines of cores of the motors are approximately at right angles to each other.

In another aspect of the present invention, the second hand is separately provided from the minute and hour hands, and a part of the gear trains for the second hand is disposed between the motors, and overlapped with the circuit chip.

These and other objects and features of the present invention will become more apparent from the following description with reference to the accompanying drawings.

DESCRIPTION OF THE PREFERRED EMBODIMENTS

Figure 1:
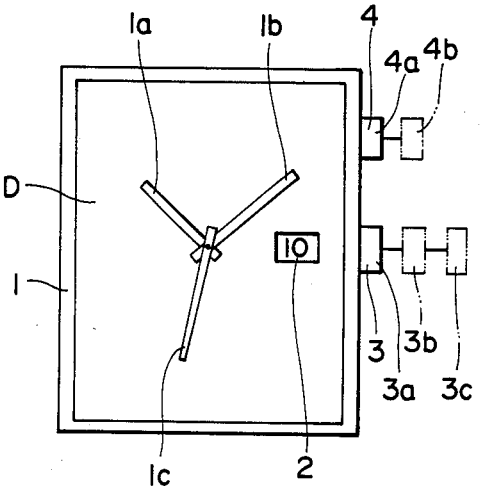
FIG. 1 is a schematic plan view of an analog time-display electronic alarm watch according to the present invention.

Referring to FIG. 1, an analog time-display electronic watch with alarm and calendar mechanisms comprises a watchcase 1, a dial D, an hour hand 1*a*, a minute hand 1*b* and a second hand 1*c*, and a date display comprising a date dial 2 as an usual watch. The second hand 1*c* is provided coaxially with the hour and minute hands.

Further, as external manipulating members, a crown 3 and a push/pull button 4 are provided. The crown 3 is normally positioned at the innermost position 3*a* and is adapted to be axially pulled to an intermediate position 3*b* and the outermost position 3*c*. The push/pull button 4 is also adapted to be set at a pushed position 4*a* and a pulled position 4*b*.

By manipulations of crown 3 and push/pull button 4, setting of an alarm time, and quick corrections of a current time and a date display can be performed. The manipulations will be hereinafter described more in detail.

Figure 2:
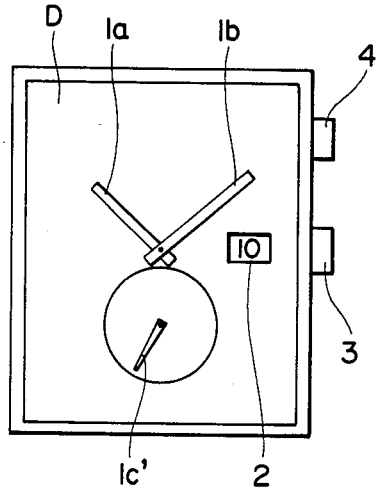
FIG. 2 is a schematic plan view showing another embodiment of the present invention.

FIG. 2 shows another embodiment of electronic alarm watch of the present invention, in which a second hand 1c' is separately provided on the dial D. The same parts as FIG. 1 are identified with the same numerals.

Figure 7:
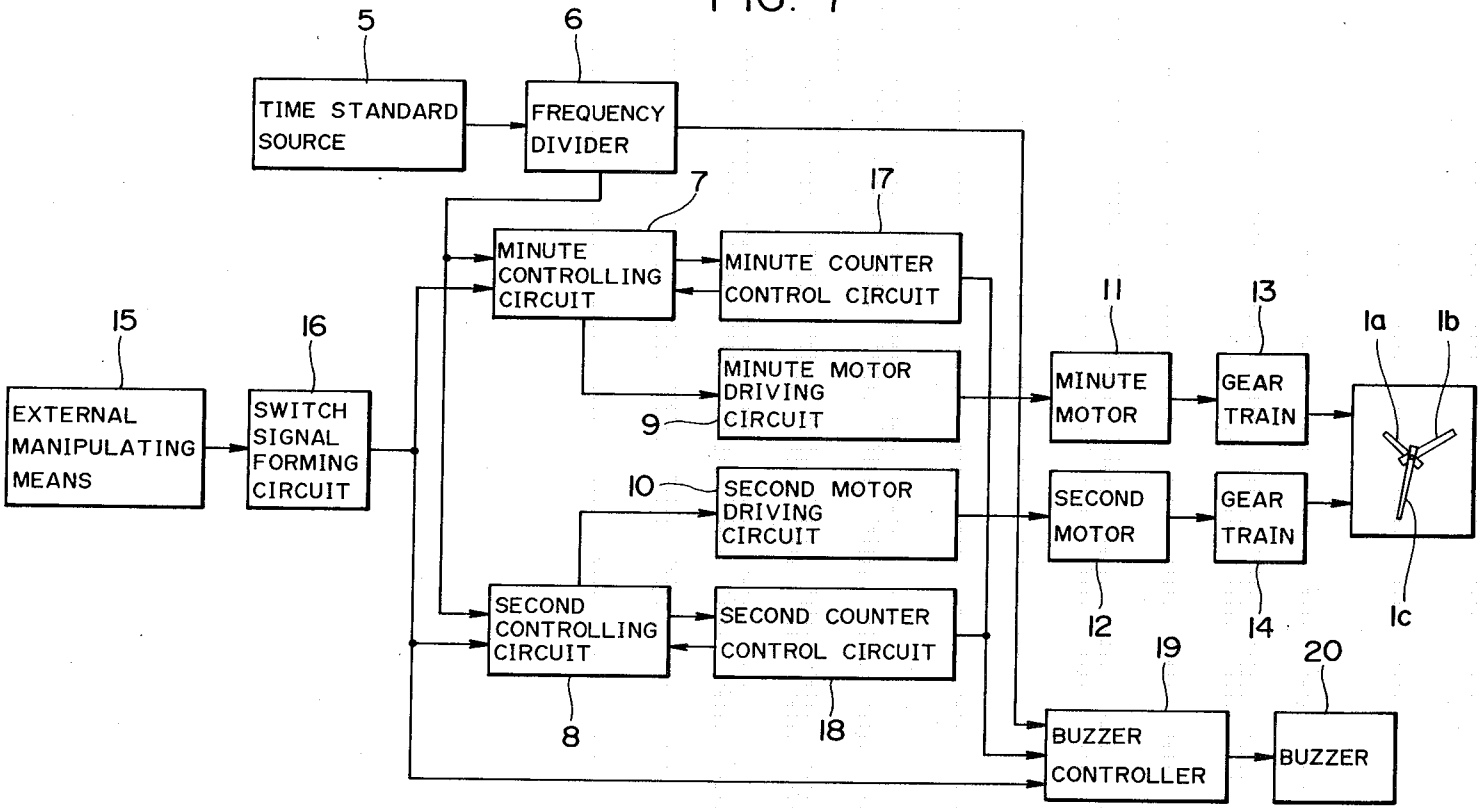
FIG. 7 is a schematic block diagram of a driving circuit of the watch.

FIG. 7 shows a schematic block diagram of a driving circuit for the watch. The circuit comprises a time standard source 5 comprising a crystal oscillator, a signal of which is divided into predetermined frequencies by a frequency divider 6 and divided signals are applied to a minute controlling circuit 7 and a second controlling circuit 8. On the other hand, external manipulating means 15 including the crown 3 and push/pull button 4 produces signals from switches provided to respond to the operations of the crown 3 and push/pull button 4. The signals are applied to a switch signal forming circuit 16 in which preventing of chattering and selecting of a switch ON or OFF signal are performed, and product signals are applied to the minute and second controlling circuits 7 and 8. A minute counter control circuit 17 and a second counter control circuit 18 are provided for checking signals of the controllers 7 and 8 respectively to operate a minute motor driving circuit 9 and a second motor driving circuit 10. Signals from the driving circuits 9 and 10 operate a minute motor 11 and a second motor 12 to drive hour, minute and second hands 1a, 1b and 1c through gear trains 13 and 14. A buzzer controller 19 is provided for producing sound signals by signals from the divider 6, circuit 16, and circuits 17 and 18 so as to operate buzzer 20 comprising a piezoelectric element and vibrator.

Figure 8:
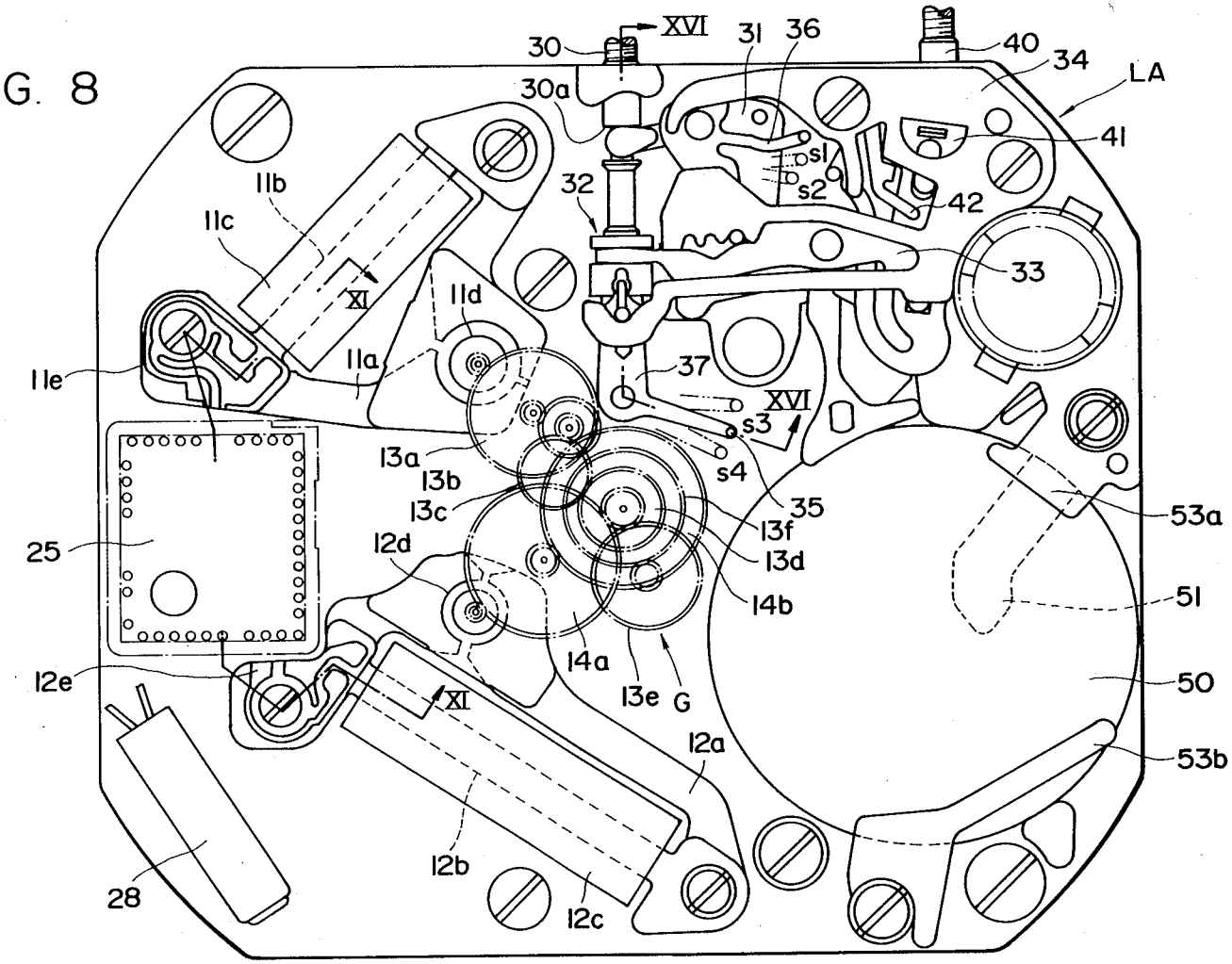
FIG. 8 is an enlarged plan view showing a gear train and a part of driving means of the watch.
Figure 9:
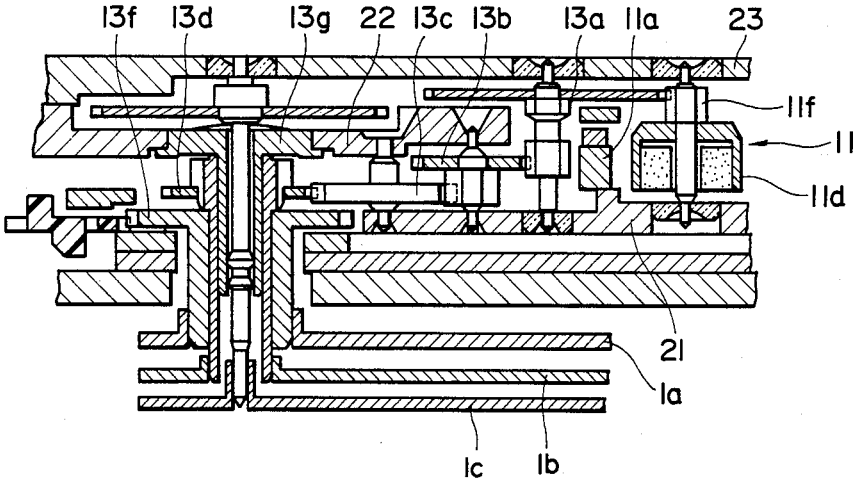
FIGS. 9 and 10 are sectional views showing the gear train of FIG. 8.
Figure 10:
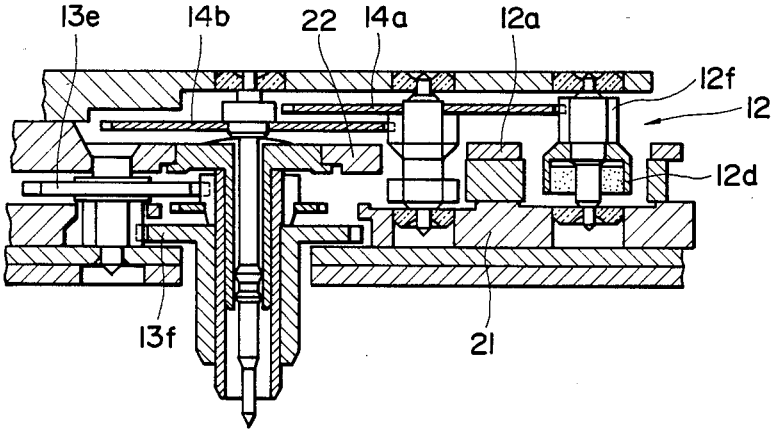

Referring to FIGS. 8 to 10, the minute motor 11 and the second motor 12 are provided for driving hour, minute, and second hands respectively through gear trains G which is disposed in a central portion of the watch, slightly deflecting from the center to one side. Both motors are disposed outside the gear train G. Motors 11 and 12 comprise stators 11a and 12a, cores 11b and 12b, coils 11c and 12c, rotors 11d and 12d, and terminal sheets 11e and 12e, respectively. Both motors are so disposed that rotors 11d and 12d are positioned so as to be adjacent to the gear trains G of the watch and that the axial lines of cores 11b and 12b make the right angle, thereby reducing the interferences between magnetic fields of both motors. A pinion 11f of rotor 11d is engaged with a fifth wheel 13a having a pinion which is engaged with a fourth wheel 13b. A third wheel 13c, meshed with a pinion of the fourth wheel 13b, is engaged with a center wheel 13d carrying the minute hand 1b. An hour wheel 13f, carrying the hour hand 1a, is rotatably engaged with a center wheel pipe of the center wheel 13d which is engaged with the center wheel pipe 13g, and the hour wheel 13f is engaged with the center wheel through a minute wheel 13e.

A pinion of the rotor 12d is engaged with an intermediate wheel 14a, a pinion of which is engaged with a second wheel 14b carrying the second hand 1c. It will be seen from FIG. 8 that the line connecting the center of rotor 11d with the center of the hands makes substantially the right angle with the line connecting the center of rotor 12d with the center of the hands.

Figure 11:
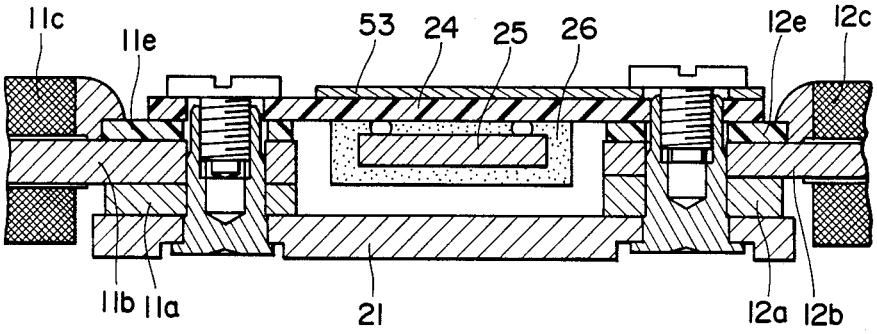
FIG. 11 is a sectional view taken along a line XI—XI in FIG. 8.

As shown in FIGS. 9 to 11, these gear trains are supported by a plate 21, a center bridge 22, and gear train bridge 23. A circuit chip 25 is mounted on a substrate 24 by a molding member 26 as shown in FIG. 11 and disposed between terminal sheets 11e and 12e for motors 11 and 12, and a crystal oscillator 28 is disposed adjacent to the circuit chip 25 to reduce the length of printed wirings formed on the substrate so as to reduce influences caused by stray capacitors on the substrate. As shown in FIG. 11, the circuit chip 25 is provided within the thickness of each of motors 11 and 12.

Figure 13:
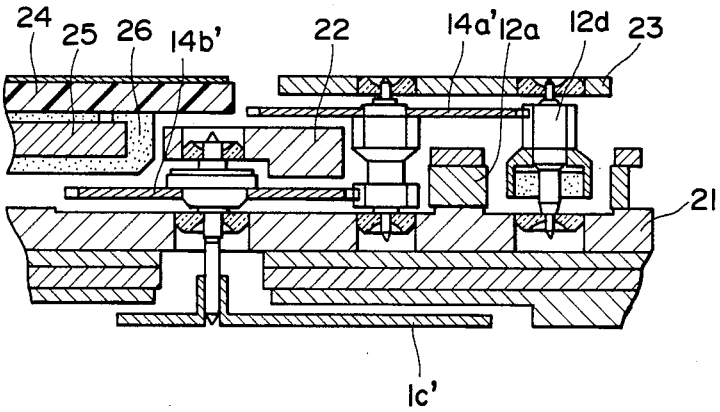
FIG. 13 is a sectional view of the gear train of FIG. 12.
Figure 12:
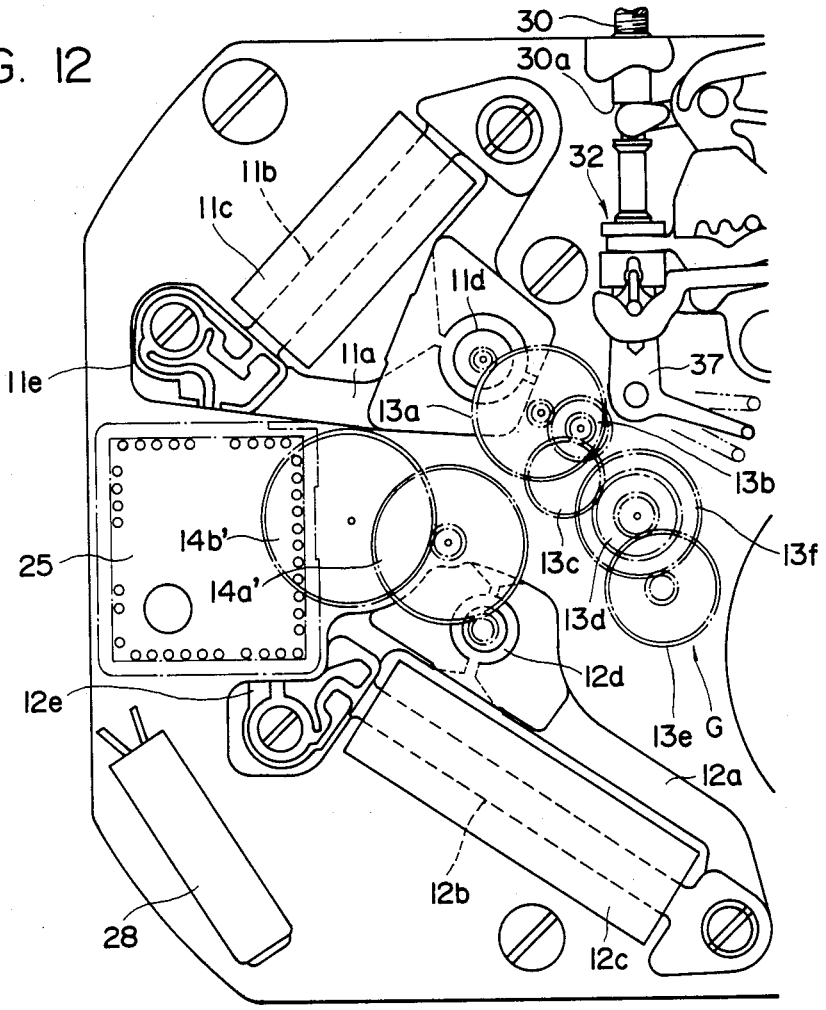
FIG. 12 is an enlarged plan view showing a gear train of another embodiment of FIG. 2.

Referring to FIGS. 12 and 13, a gear train of the embodiment of FIG. 2 comprises an intermediate wheel 14a' engaged with the rotor 12d, and a second wheel 14b' engaged with a pinion of the intermediate wheel 14a' and carrying the separated second hand 1c' The gear train for the separated second hand is independently supported on the plate 21 and gear train bridge 23, and the second wheel 14b' is disposed between the center bridge 22 and plate 21. As shown in FIG. 12, the circuit chip 25, covered by molding material and mounted on the substrate 24, is overlapped with the second wheel 14b' whereby the second wheel 14b' can be provided without a special horizontal and vertical space.

From the foregoing, it will be seen that the gear trains for hour, minute and second are disposed in a position adjacent to the axis of the minute hand (the central portion of the watch) and that gear trains for hour and minute at this central location are disposed between the plate 21 and the center bridge 22; the gear train for seconds being disposed between the center bridge 22 and the gear train bridge 23, so that both gear trains are independently provided from each other.

Figure 14:
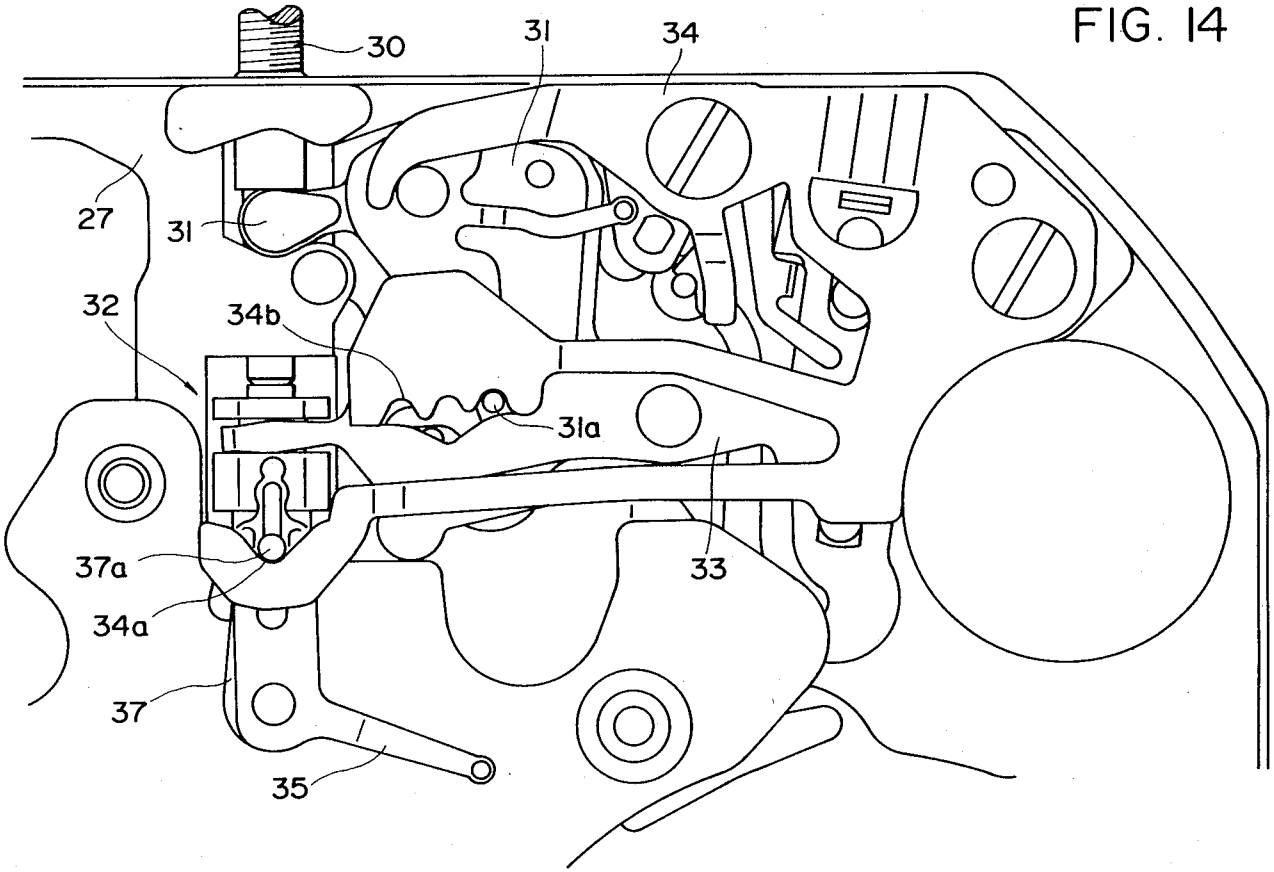
FIGS. 14 and 15 are partly enlarged plan views of the watch movement, some pieces having been removed.
Figure 15:
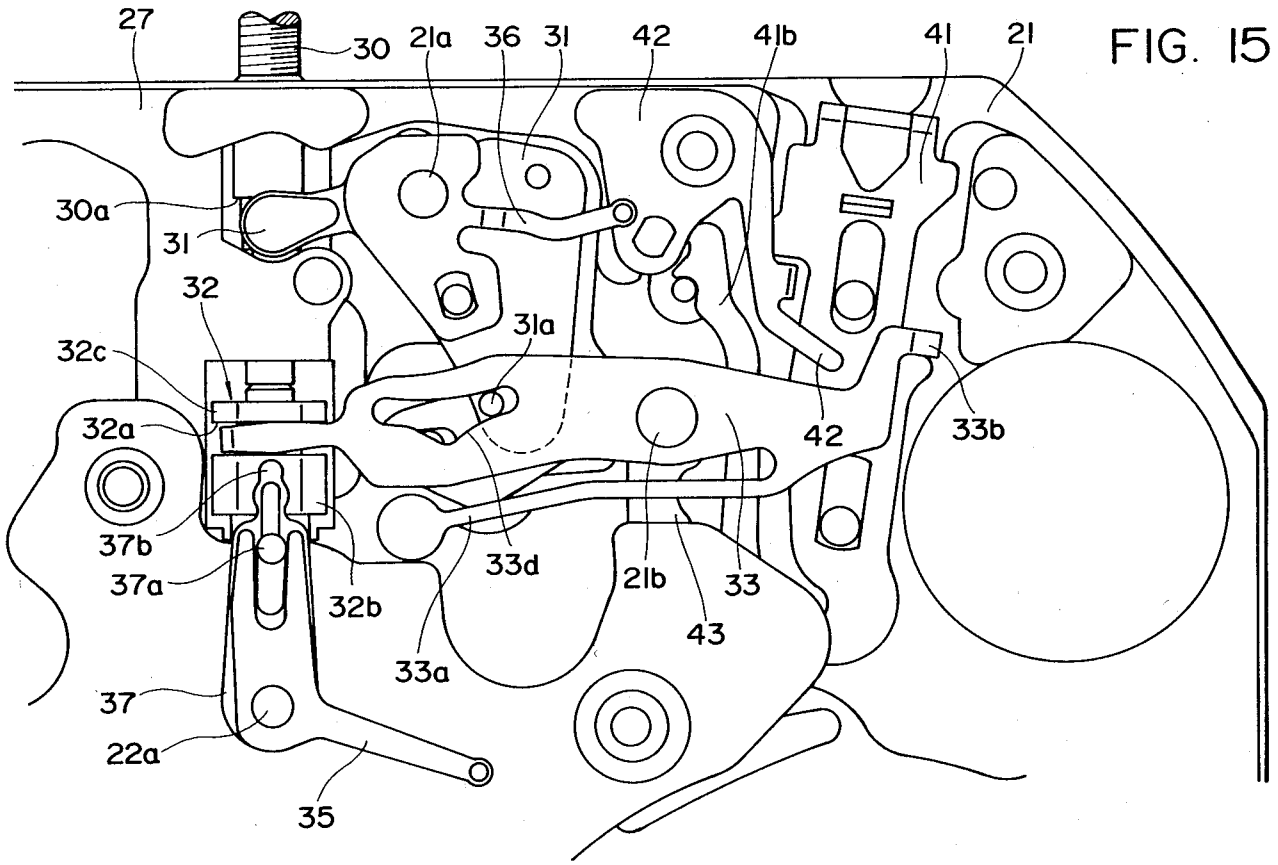
Figure 16:
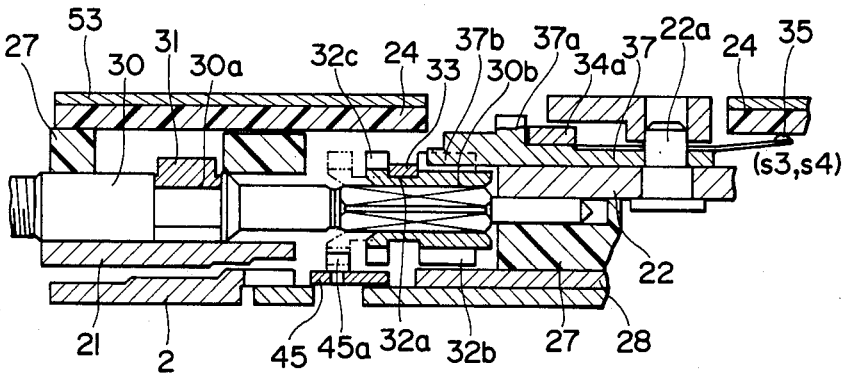
FIG. 16 is a sectional view taken along a line XVI—XVI of FIG. 8.

Referring to FIGS. 14 to 16, a stem 30 having the crown 3 is disposed adjacent the motor 11 and supported between the plate 21 and a spacer 27 and an inner end of the stem 30 is supported between the center bridge 22 and spacer 27. As seen from FIG. 8, a lever assembly LA for changing the operational state of the watch is disposed in a space which is opposite side of the motor 11 with respect to the stem 30. The lever assembly LA comprises a setting lever 31 and a clutch lever 33. The stem 30 is formed with a groove 30a for engaging the setting lever 31 and a square portion 30b for carrying a sliding clutch wheel 32 which is provided with a groove 32a for receiving the clutch lever 33. Thus, the clutch wheel 32 is adapted to rotate in cooperation with the stem 30 and is axially slid by the clutch lever 33. As shown in FIG. 16 the clutch wheel 32 has two teeth 32b at an end thereof, and means is provided to generate two pulses per one rotation of the stem 30. Each tooth 32b has a flat periphery.

Figure 19:
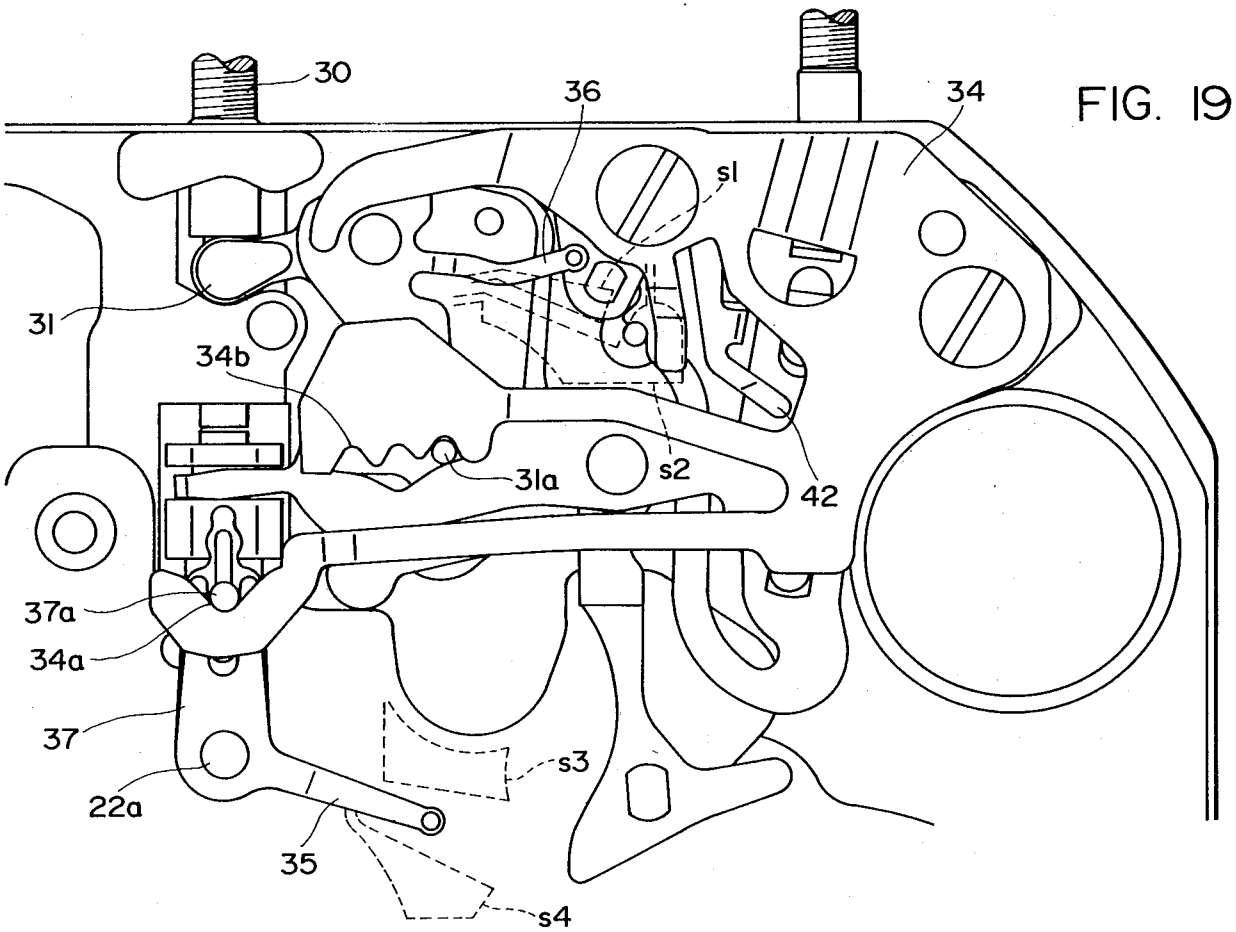
FIGS. 19, 20 and 21 are partly enlarged plan views of the watch movement, in which three different operating positions for switching mechanisms are shown.

A switch lever 37 is pivotally mounted on a pin 22a secured to the center bridge 22 and an end 37b is adapted to engage with one of teeth 32b of the clutch wheel 32. The switch lever 37 is provided with a projection 37a engaged with a notch 34a forming on an end of a spring portion of a setting lever spring 34 so that the switch lever is held at a neutral position which is on the axial line of the stem 30. A first switch spring 35 is secured to the switch lever 37. When the stem 30 is rotated by crown 3, the switch lever 37 is rocked about the pin 22a so that the switch spring 35 contacts to switch contacts provided on substrate 24 to turn on a switch S3 or S4 according to the movement of the lever 37, as shown in FIG. 19.

Figure 17:
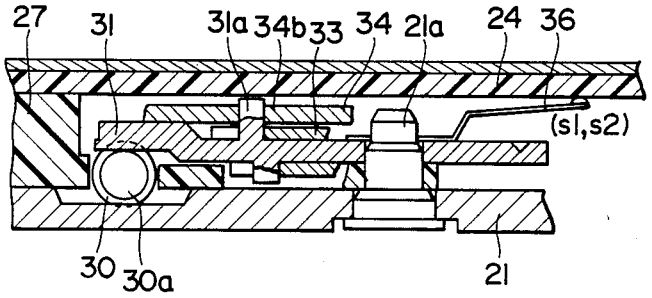
FIGS. 17 and 18 are sectional views each showing a part of the watch movement.
Figure 18:
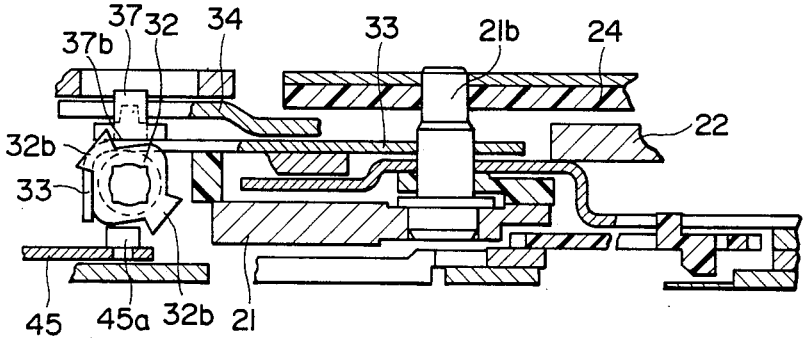

Referring to FIGS. 15, 17 and 18, the setting lever 31 engaged with the groove 30a of the stem 30 is pivotally mounted on a shaft 21a on the plate 21. The setting lever 31 is provided with a projection 31a to be engaged with any one of three notches 34b formed on one of arms of the setting lever spring 34 so as to hold the stem 30 axially in three positions 3a, 3b and 3c. A second switch spring 36 is secured to the setting lever 31. According to the shifting of the setting lever 31, the switch spring 36 contacts one of contacts forming switches S1 and S2 (FIG. 19).

The clutch lever 33, pivotally mounted on a shaft 21*b* to the plate 21 (FIG. 15) is formed with a cam groove 33*d* engaged with the projection 31*a* so that the clutch lever 33 is moved in accordance with the shifting of the stem 30. When the stem 30 is at the innermost position 3*a* (FIG. 1), the clutch lever 33 is at the position of FIG. 19, so that the tooth 32*b* of wheel 32 engaged with the end 37*b* of the switch lever 37. When the stem is pulled to the intermediate position 3*b*, the clutch lever 33 is rocked in the clockwise direction by an elasticity of a spring portion 33*a* because of the shape of the cam groove 33*d*. Accordingly, the clutch wheel 32 is outwardly moved (to the crown 3), so that the tooth 32*b* disengaged from the end 37*b*. When the stem is pulled to the outermost position 3*c*, the clutch lever 33 is rocked in the counterclockwise direction to the position of FIG. 18, so that the tooth 32*b* engages with the end 37*b*.

Figure 22:
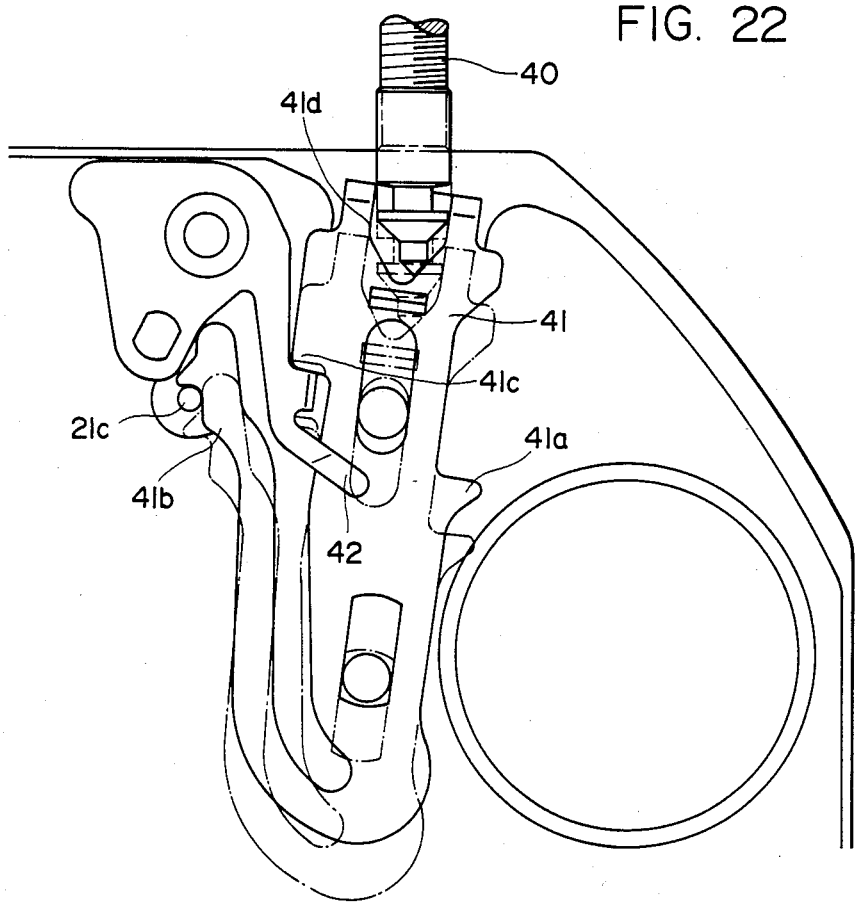
FIG. 22 is a partly enlarged plan view showing a portion relative to change lever.
Figure 23:
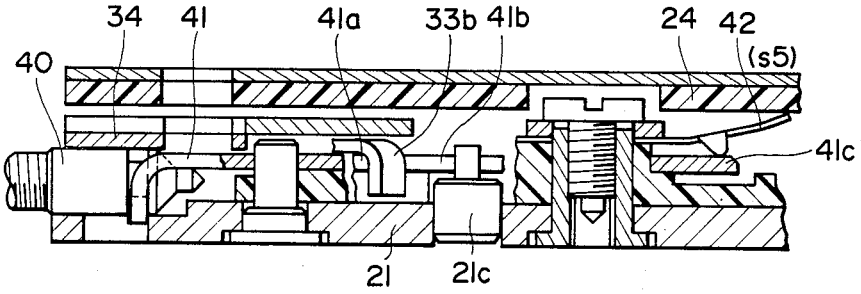
FIG. 23 is a sectional view of the portion of FIG. 22.

Referring to FIGS. 22 and 23, a stem 40 supporting the push/pull button 4 is engaged with a hole 41*d* formed in a change lever 41 having a projection 41*a* which is adapted to engage with a bent portion 33*b* (FIG. 15) of the clutch lever 33 for restricting the rocking of the clutch lever 33 when the stem 40 is pulled. The change lever 41 is provided with a click spring portion 41*b* engaged with a pin 21*c* on the plate 21 and a bevel 41*c* for moving a third switch spring 42 to engage with a contact on the substrate 24 (switch S5). When the push/pull button 4 is at the pushed position 4*a*, the switch S5 is turned on to stop the alarm sound (alarm OFF-state). At the pulled position 4*b*, the switch S5 is turned off to set the alarm system to the alarm ON-state (alarm expect state).

As shown in FIG. 8, a battery 50 is disposed between the lever assembly LA and the motor 12.

Figure 24:
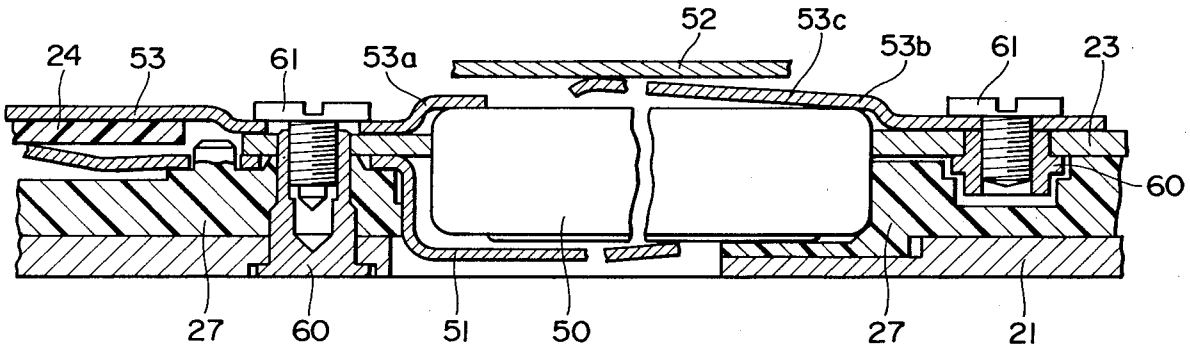
FIG. 24 is a sectional view showing an arrangement of a battery.

Referring to FIG. 24, a circuit cover 53 is disposed on the substrate 24 for preventing the deflection of the substrate and is formed with a grounding spring portion 53*c* engaged with a vibrating plate 52. The battery 50 is supported by supporting lugs 53*a* and 53*b* projected from the cover 53 and a spring plate 51 provided under the battery 50. Further, the periphery of the battery 50 is held by spacer 27 and gear train bridge 23. Further, a base portion of each lug 53*a* (53*b*) is fixed to plate 21 and bridge 23 by a screw tube 60 and screw 61. Thus, the minus electrode of the battery 50 is directly connected to the ground on the back of the watch.

Describing the manipulations and operations of the watch, switching conditions according to the operations of the external manipulating means 15 (FIG. 7) are listed as follows.

| crown position | 3a | 3b | 3c |
|---|---|---|---|
| second switch spring (36) | S1:OFF<br>S2:OFF | S1:ON<br>S2:OFF | S1::OFF<br>S2:ON |
| crown rotation | | right (R) | left (L) |
| first switch spring (35) | | S3:ON<br>S4:OFF | S3:OFF<br>S4:ON |
| push/pull button | | 4a | 4b |
| third switch spring (42) | | S5:ON | S5:OFF |

In the ordinary position 3*a* (FIG. 19, S1, S2: OFF), the minute motor 11 is rotated at 1/20 Hz and the hour and minute hands 1*a*, 1*b* rotate at the rate of one step per twenty seconds. The second motor 12 is rotated at 1 Hz and the second hand 1*c* (1*c*') rotates at the rate of one step per one second. In this state, switches S3, S4 are controlled by the circuit 16 to be dead, so that if the crown 3 is rotated, no signals generate from the switches.

Figure 3:
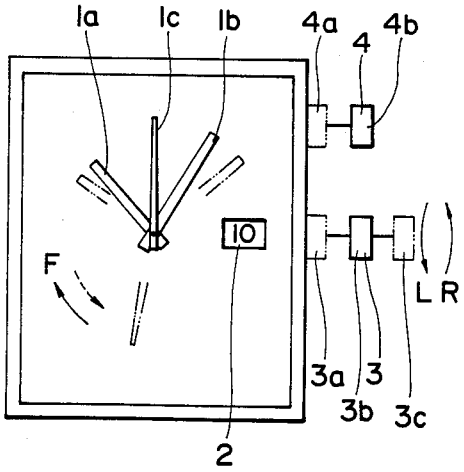
FIGS. 3 and 4 are plan views of the watches of FIGS. 1 and 2 showing operations for alarm time setting.
Figure 4:
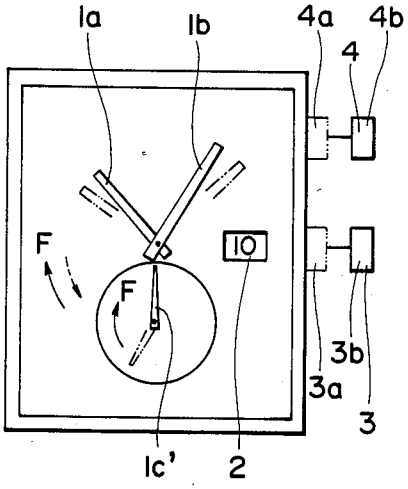
Figure 5:
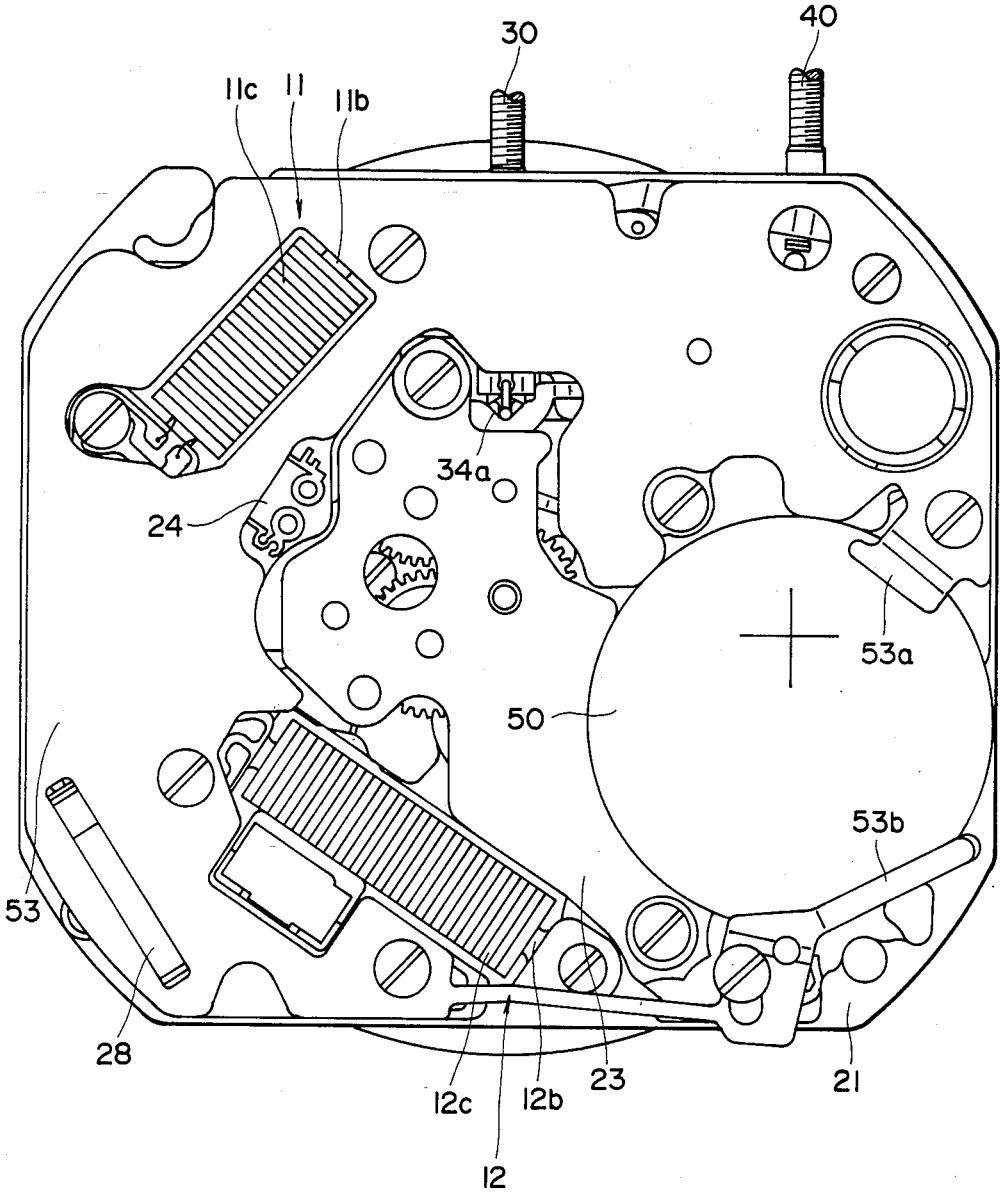
FIG. 5 is a plan view of the rear side of the watch movement in the watch of FIG. 1.
Figure 6:
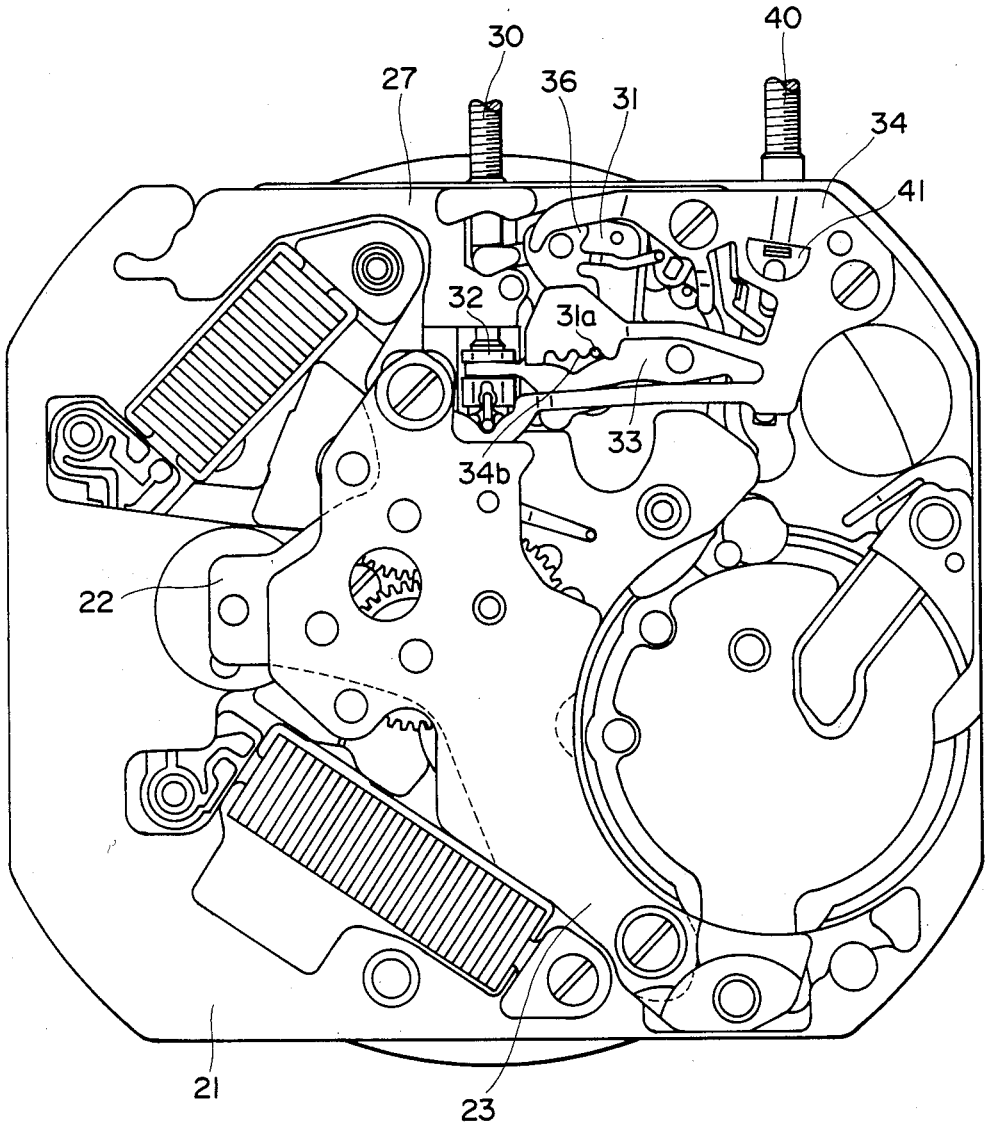
FIG. 6 is a similar plan view of FIG. 5, some pieces having been removed.
Figure 20:
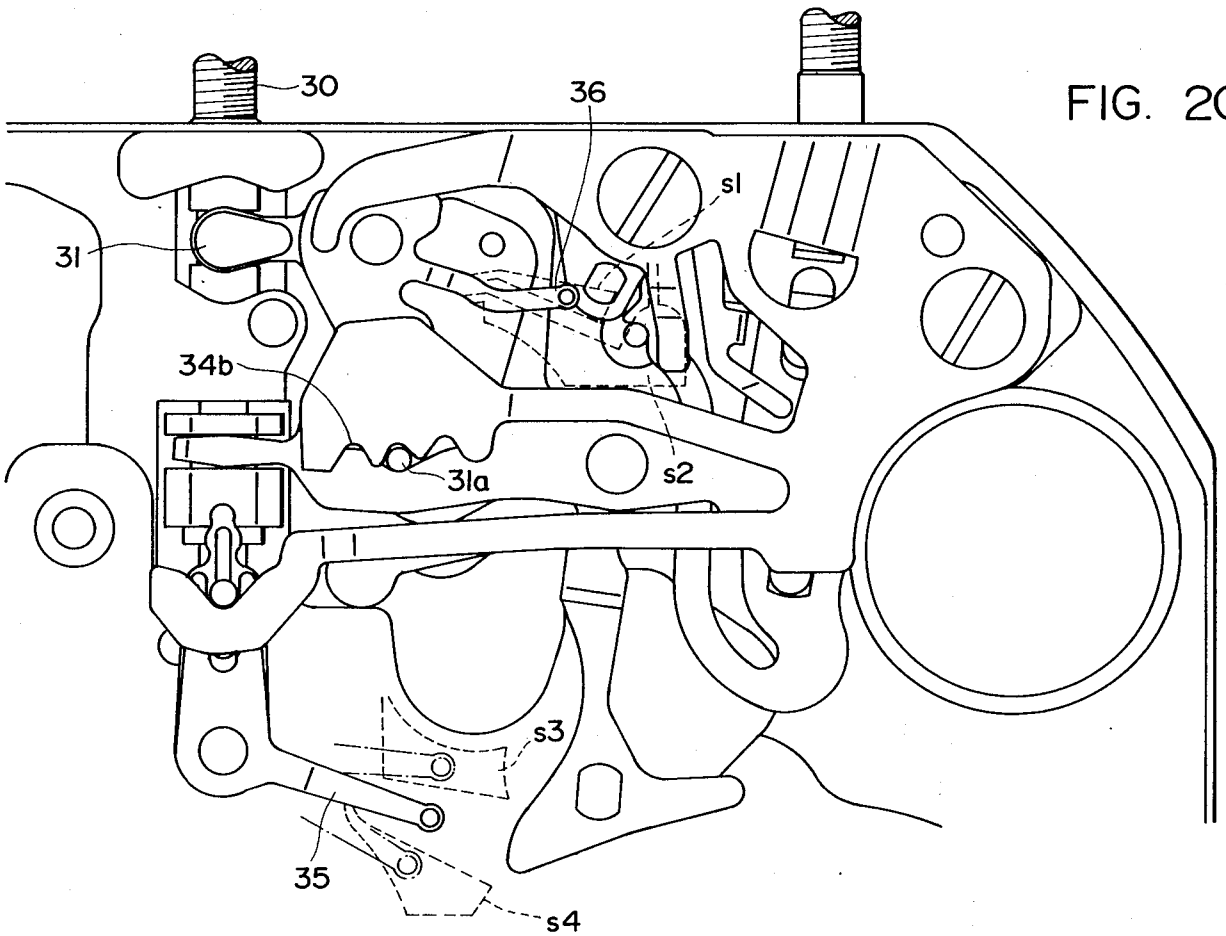
Figure 21:
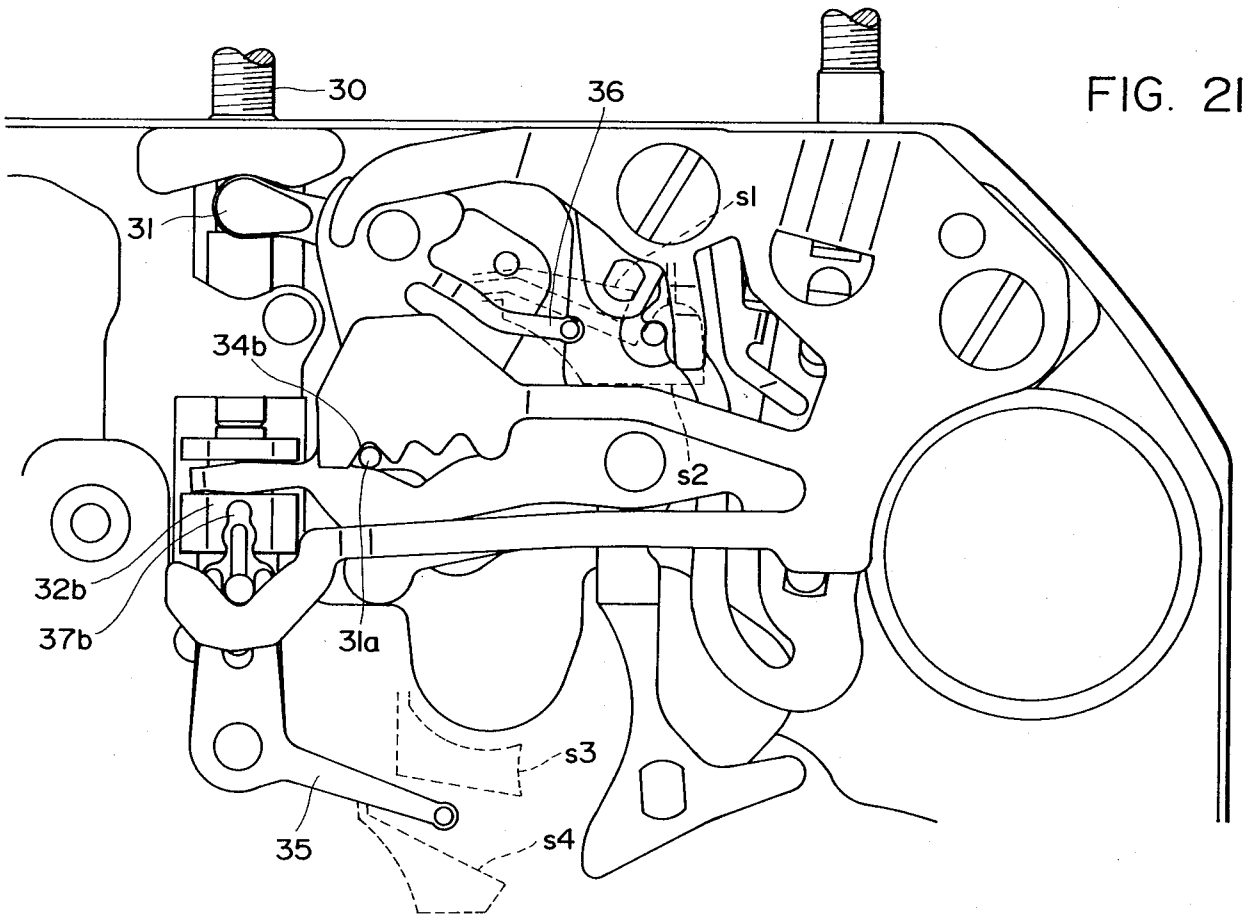

AS shown in FIGS. 3 and 4, in order to set an alarm time, first, the push/pull button 4 is pulled to the pulled position 4*b* (S5: OFF) and the crown 3 is pulled to the intermediate position 3*b* (FIG. 20, S1: ON) so that the alarm time setting circuit is turned on. By this manipulation, the second motor 12 quickly rotates at 64 Hz and the second hand 1*c* (1*c*') is automatically driven to the zero second position at high speed. The minute motor 11 quickly rotates at 128 Hz and the hour hand 1*a* and minute hand 1*b* are rotated in the clockwise direction (in the direction of the arrow F of FIG. 3) at high speed to positions corresponding to the alarm time which is previously set by a user.

Decision of the zero second position for the second hand 1*c* is made by operation of a counter dependent on the signal from the control circuit 18.

During the high speed driving operations of hands for setting an alarm time, the control circuit operates to disable switches S3 and S4 even if the crown 3 is rotated.

When hour and minute hands are at stops at the alarm time indicating position, a new alarm time can be set by rotating the crown 3. When the crown 3 is rotated in the counterclockwise direction L (FIG. 3), switch lever 37 is rocked by teeth 32*b*, so that the switch S3 is turned on twice per one revolution of the stem 30. If the crown is rotated once or more within ⅛ second, hour and minute hands are clockwisely rotated at high speed. On the other hand, when the crown 3 is rotated at a slow speed lower than the above speed, hour and minute hands are rotated at the rate of two minutes step per one revolution of the stem. After rotating the crown 3, when user's fingers are removed from the crown, the switch lever 37 is returned to the neutral position by the notch 34*a* of the setting lever spring 34.

When the crown 3 is rotated in the clockwise direction R, hour and minute hands are counterclockwisely rotated in the same manner as the rotation of the direction L. During this operation, the second hand is also stopped at the zero position. The system is so arranged that during high speed rotations of hour and minute hands, if the crown 3 is rotated in either direction to turn on switch S3 or S4, the hands stop.

After the alarm time is set, when the crown 3 is pushed to the innermost position 3*a* to open the switch S1, or the push/pull button 4 is pushed to turn on the switch S5, hour and minute hands 1*a*, 1*b* are automatically quickly driven in the counterclockwise direction and returned to positions indicating the current local time. The second hand 1*c* (1*c*') is also returned to the current time position.

In order to quickly correct the date display, the push/pull button 4 is set to the pushed position 4*a* and the crown 3 is pulled to the intermediate position 3*b*. In such a state, the tooth 32*b* of the clutch wheel 32 disengages from the end 37*b* of the switch lever 37, and a tooth 32*c* engages with a pin 45*a* of a quick correcting lever 45. Thus, when the crown 3 is rotated in the direction of the arrow R, the date dial 2 is driven through the lever 45.

When the crown 3 is pulled to the outermost position 3*c*, the switch S2 is turned on. By the turning on of the switch S2, the system is changed to a current time correction state. The correction is done in the same manner as the alarm time setting. However, the second hand 1*c* is not rotated to the zero position, but it stops at the position when the stem 30 is pulled. Hour and minute hands can be rotated quickly or step by step by rotating the crown for the correction of the time, as the setting of the alarm time.

From the foregoing, it will be understood that the present invention provides an electronic alarm timepiece in which gear trains are positioned in a substantially central portion of the timepiece, and a battery, motors and lever assembly are disposed around the gear trains, whereby the timepiece can be made into a thin construction. Since a circuit chip is disposed between motors, the size of the timepiece can be reduced. Further, cores of both motors are arranged making the right angle with each other, so that the interference of magnetic fields can be reduced to ensure the accuracy of the operations of both motors.

While the invention has been described in conjunction with preferred specific embodiments thereof, it will be understood that this description is intended to illustrate and not limit the scope of the invention, which is defined by the following claims.

What is claimed is:

1. An electronic timpiece having a mechanical analog time-display with hour, minute and second hands, said minute hand rotating about an axis, said electronic timepiece comprising:

a case;

a circuit chip disposed in said case at a peripheral portion thereof;

a crystal oscillator disposed at a peripheral portion of the case and adjacent said circuit chip;

first and second motors disposed in said case adjacent said circuit chip at opposite sides thereof;

a first gear train disposed between said first motor and said minute and hour hands for driving said minute and hour hands;

a second gear train disposed between said second motor and said second hand for driving said second hand;

supporting plates for supporting said first and second gear trains;

an indicator hand;

a third gear train for driving said indicator hand;

said second motor, circuit chip and first gear train being disposed to form a space therebetween to enable positioning of said third gear train therein to facilitate driving of said indicator;

a part of said supporting plates being extended into said space for supporting said indicator hand and third gear train;

stem axially shiftably provided in said case adjacent said gear trains;

a lever assembly disposed in said case adjacent the gear trains and operatively connected to the stem for changing the operational state of the timepiece; and a battery disposed in said case between said lever assembly and one of said motors.

2. The electronic timepiece according to claim 1 wherein the circuit chip is disposed in said case within the thickness of the motors.

3. The electronic timepiece according to claim 1 wherein the second hand is separately provided from the minute and hour hands.

4. The electronic timepiece according to claim 3 wherein a part of the gear trains for the second hand is disposed between the motors.

5. The electronic timepiece according to claim 3 wherein a part of the gear trains for the second hand overlaps with said circuit chip.

6. The electronic timepiece according to claim 2 wherein the rotor of each motor is disposed in said case adjacent a central portion of the timepiece.

7. The electronic timepiece as claimed in claim 1, further comprising means for setting said hour and minute hands to a desired position on said time-display utilizing the other of said two motors, at a relatively high rate of speed.

8. The electronic timepiece as recited in claim 1, wherein said at least two motors each have cores having axial lines and said axial lines being disposed to form an approximately right angle.

9. The electronic timepiece according to claim 1, wherein said two motors each have cores having axial lines and said axial lines being disposed to form an approximately right angle.

10. The electronic timepiece according to claim 1, wherein said indicator hand is the second hand.

11. The electronic timepiece according to claim 10, wherein a gear securely mounted on shaft of said indicator hand overlaps said circuit chip.

12. The electronic timepiece according to claim 10, wherein said second hand is disposed on a line connecting an axis of said minute hand and a position of six o'clock.

* * * * *